US006279542B1

(12) United States Patent
Lindblom

(10) Patent No.: US 6,279,542 B1
(45) Date of Patent: Aug. 28, 2001

(54) METHOD AND ARRANGEMENT FOR CONTROLLING THE INJECTION PRESSURE OF LIQUID FUEL

(75) Inventor: Jan Lindblom, Lycke (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/254,648

(22) PCT Filed: Sep. 9, 1997

(86) PCT No.: PCT/SE97/01510

§ 371 Date: Jun. 16, 1999

§ 102(e) Date: Jun. 16, 1999

(87) PCT Pub. No.: WO98/11340

PCT Pub. Date: Mar. 19, 1998

(30) Foreign Application Priority Data

Sep. 10, 1996 (SE) ..... 9603279

(51) Int. Cl.[7] ..... F02M 45/00
(52) U.S. Cl. ..... 123/506
(58) Field of Search ..... 123/506, 501; 251/129.01, 129.09, 129.15, 129.16

(56) References Cited

U.S. PATENT DOCUMENTS 4,485,969 * 12/1984 Deckard et al. ..... 123/506
4,753,212 * 6/1988 Miyakai ..... 123/506
5,443,047 * 8/1995 Ishiwata et al. ..... 123/506
5,517,973 5/1996 Askew et al. .
5,526,791 * 6/1996 Timmer et al. ..... 123/506

FOREIGN PATENT DOCUMENTS 37 41 526 C2 6/1989 (DE) .
0 124 191 A2 11/1984 (EP) .
0 193 788 B1 9/1986 (EP) .
0 200 373 A2 12/1986 (EP) .
0 588 475 A2 3/1994 (EP) .
89/00242 1/1989 (WO) .

* cited by examiner

*Primary Examiner*—Andrew M. Dolinar
*Assistant Examiner*—Arnold Castro
(74) *Attorney, Agent, or Firm*—Lerner, David, Littenberg, Krumholz & Mentlik, LLP

(57) ABSTRACT

Methods and apparatus for controlling fuel injection pressure for fuel through a nozzle for combustion in an engine are disclosed. These include methods and apparatus for injecting the fuel at an injection pressure by means of an injector, maintaining the pressure during injection by closing a primary control valve for the fuel, and releasing a portion of the pressure during a predetermined portion of the fuel injection.

10 Claims, 5 Drawing Sheets

METHOD AND ARRANGEMENT FOR CONTROLLING THE INJECTION PRESSURE OF LIQUID FUEL

TECHNICAL FIELD

The present invention relates to a method and arrangement for controlling the pressure when injecting fuel, such as diesel oil, in an engine, whereby the pressure in a conventional way is obtained by a piston which is driven by a cam shaft and which presses oil out through a nozzle connected to a cylinder cavity in which the piston works. The spray nozzle is provided with small narrow holes through which the liquid fuel is atomized.

PRIOR ART

Many different arrangements for injecting diesel oil are known hitherto. They differ substantially from each other but have in common that a high pressure must be obtained so that the liquid is atomized and that the injection must occur quickly and start as a predetermined moment and be completed at a predetermined limited moment. Most arrangement are therefore based on the principle that a piston presses the fuel against a nozzle having holes at such high speed that a pressure of in the order of amount 300 Bar is created, whereby the injection of the fuel starts. This can occur by making the injection holes so small that they cannot allow all fuel which is pressed against them to pass. The pressure continues to rise even though fuel is flowing out from the nozzle. To release the pressure a connection between the pressure chamber and a valve is arranged, which valve opens when the injection is to be completed so that the pressure instantaneously drops to a zero value. The oil which flows through this regulating valve when it is opened flows via a drainage pipe back to the oil store.

The regulating valve is usually actuated by an electromagnet. It is of great importance that this valve works instantaneously since the whole injection cycle takes only time of in the order of 3 ms (milliseconds) having a highest pressure of about 1500 Bar.

The pressure-creating device, usually a piston in a cylinder, has usually a simple construction and the variations of the fuel injection arrangements which are present relate mostly to the controlling or steering valve which is connected to the fuel pressure. Examples of such arrangements are described in the German patent specification 3741526, the international patent application WO 89/00242, the European patent specification 0193788 and the American patent specification 5517973. All these patent descriptions describe quite different arrangements and it is therefore difficult to compare them with each other and with other prior art.

THE TECHNICAL PROBLEM

In the known arrangements having only one controlling valve the fuel pressure is built up quickly to a value of in the order of 300 Bar and it increase thereafter to about 1500 Bar until the pressure is released by means of the control valve. The injection through the injection holes starts at about 300 Bar. At the beginning of the injection cycle the fuel is combusted with relatively large formation of nitrogen oxide ($NO_x$), which from an environmental view is a disadvantage. Since the content of nitrogen oxides is limited by law, which law is continually made more stringent the moment of injection and thus the combustion must normally be postponed to reduce the contamination. This postponement has a negative influence on the efficiency of the engine. A further disadvantage with known arrangements is that at high speeds the pressure can be built up too quickly and become too high above the limit which the injection construction allows. It is therefore a requirement to be able to influence the pressure or to relieve it somewhat during the injection cycle at chosen moments, such as at the beginning, in order to decrease the $NO_x$ emission and at the end to avoid too high pressures.

THE SOLUTION

According to the present invention, the above problem has been solved by a control valve which only closes and opens and an arrangement and a way of regulating the injection pressure of liquid fuel, such as diesel oil, by a nozzle having narrowed injection openings has been brought about, the pressure being created by a quick action from, for example, a piston in a cylinder and a main control valve in connection with the liquid fuel before the nozzle, which main control valve is kept closed during the injection, which method is characterized in that the pressure is relieved at a suitable moment during the injection cycle through a secondary valve.

According to the invention, it is suitable that the injection pressure is relieved at the beginning of the injection cycle for decreasing developed nitrous gases ($NO_x$) during combustion.

According to the invention, it may also be suitable that the injection pressure is relieved at the end of the injection cycle to allow higher speeds of the pressure-creating piston or the like.

The invention also comprises an arrangement for regulating the injection pressure of liquid fuel such as diesel oil by a nozzle having narrowed injection openings, whereby the pressure is created by a quick action from, for example, a piston in a cylinder and control valve in connection with the liquid fuel before the nozzle, which main control valve is kept closed during the injection, which arrangement is characterized in that a secondary valve within the main control cylinder for relieving the injection pressure.

According to the invention, the main control valve comprises a moveable valve body, which through an electromagnet, can be moved up and down against a first spring force having an enlargement at its lower part which is intended to co-operate with a surrounding housing to create a valve which can be closed or opened for the flow of liquid between the housing and the valve body, which liquid-flow is connected to the liquid before the liquid injection nozzle, which arrangement is characterized by a moveable rod within the valve body which is attached to the up and down moveable part of the electromagnet and which at its other end carries a second spring abutting against the lower part of the valve body, which second spring is stiffer than the first spring acting on the valve body, wherein radial holes have been made in the valve body inwardly against the rod and in that the rod co-operate with the valve body to make a valve.

According to the invention it is suitable that the radial holes in the valve body are located somewhat above the edge where a narrowing in the rod starts so that passage of liquid through the holes is prevented when the rod is located in its lower position with the stiffer second spring expanded.

It is also possible according to the invention that the radial holes in the valve body end in a ring-shaped part in the valve body around the rod and that the lower part of the ring-shaped part and a circular edge delimiting a narrowing of the rod make a valve.

According to the invention, it is suitable that the outlet side for the flow in both the main valve and the secondary valve drain into the fuel store.

According to the invention, it is suitable that the first spring acting on the valve body abuts with its other end via a support against the upper side of the body and with its second end against a part of the housing.

According to the invention, both springs are suitably co-axial and the electromagnet is arranged to be activated in at least two steps, whereby in the first step the main control valve is closed and in the second step when the main control valve is closed the secondary control valve is opened.

FIGURE DESCRIPTION

The invention will in the following be described more in detail in connection with the enclosed drawings where FIG. 1 schematically shows an injection arrangement for fuel with a control valve of known kind, where FIG. 2 shows the same arrangement with the control valve in another position, where FIG. 3 shows the control arrangement according to the present invention having an open main control valve and a closed secondary valve, where FIG. 4 shows the same arrangement as according to FIG. 3 but with a closed main valve and an open secondary valve and where FIG. 5 shows another embodiment of the control valve according to the present invention having an open main control valve and a closed secondary valve.

DETAILED DESCRIPTION

FIG. 1 shows schematically a fuel injection device according to the prior art having a piston 1 which is forced down into a cylinder 2 in which the liquid fuel is present. The approximate piston stroke can be in the region of 15–17 mm. It is accordingly a question of very small and quick movements of the piston 1 which usually are activated from the cam shaft. From the cylinder cavity a conduit 3 leads to the injection nozzle. This comprises usually a wart-like device having for, example, eight injection holes with a diameter of 0.2 mm.

From the injection conduit 3 a branch conduit 4 leads to a control valve which is denoted throughout with the reference numeral 5. This is influenced by an electromagnet 6 having an upper stationary part and an under part being moveable upwards and downwards. From this lower moveable part a rod 7 extends downwardly and a valve body 8 is connected to this rod 7. Around the valve body 8 a housing 9 is arranged and this housing 9 is shaped with a valve seat 10 which, together with the body 8, forms a valve. The valve body 8 is kept in the downwardly pressed position by means of a first spring 11. However, when the electromagnet is activated the valve body 8 is lifted and the valve is closed.

When the fuel shall be injected into the engine through the nozzle from the fuel conduit 3, this control valve must be closed. If not, no pressure in the conduit 3 can be built up and the fuel takes the route through the control valve and out through the drainage conduit 12.

Below the schematic construction drawing of the injection arrangement the force influence from the electromagnet is shown first in FIG. 1B. The influence is as appears from the start 0, but at the point A the electromagnet is activated and it is kept activated by an even force until the point B when it again is deactivated.

In FIG. 1C the resulting injection pressure is shown. As appears from the figure, this pressure is practically 0 at the beginning, but it first builds up to the point C when it obtains a value of about 300 Bar when the injection starts through the holes in the nozzle, as a result of which the curve is given a push downward to thereafter continue up to the point D where the pressure can receive a value of about 1500 Bar. At the point D the electromagnet is deactivated and the pressure sinks quickly down to a very small value. When the pressure has come down, the injection will accordingly cease through the nozzle and the remaining pressure brings about only a flow through the open valve and the drainage conduit 12 to the fuel storage.

FIG. 2 shows the same arrangement as the one according to FIG. 1, but in this case the control valve is open and the fuel flow will then go, as appears from the figure, via the connecting conduit 4 and the open valve 8, 10 through the drainage conduit 12. No injection will occur in this case.

FIG. 3 shows a control valve according to the present invention where the denotations 4–12 relate to the same elements as in FIGS. 1 and 2. What distinguishes this figure from FIGS. 1 and 2 is that radial holes 13 are made in the valve body 8, which holes face towards the cylindrical rod 7. Additionally, the cylindric rod 7 has been made narrowing at the part 14 below the level for the radial holes 13 and the lowest part 15 of the rod 7 has been provided with plane surfaces so that liquid can flow between this lower part of the rod 7 and the hollow valve body 8. The lowermost part 16 of the rod 7, which is a plate, carries a second spring 17 which at its other end abuts against a plane underside of the valve body 8. This second spring 17 is stiffer than the first spring 11 between the valve body 8 and the housing 9. The valve body 8 is provided at its lower part with a pressed in plate 19 which preloads the spring 17 and determines the basic position for the rod 7.

The housing 9 is provided below the valve with an abutment 20 which makes a stop for the valve and which, through its position, determines the basic position of the valve in its opened position.

In the position which the figure shows, the secondary valve, i.e. the valve which consists of the rod 7 against the valve body 8, is closed whereas the main valve is open and the fuel liquid can therefore flow past the main valve and out through the drainage opening 12.

When the electromagnet 6 is activated, the lower part thereof will be pulled against the upper stationary part which means that it, together with the rod 7, will be pulled upwardly. Since the first spring 11 is weaker than the second spring 17, the spring 11 will thereby be compressed until the valve body 8 has abutted against the valve seat 10 on the housing 9 and accordingly closed the main control valve. On further stronger activation of the electromagnet, the rod 7 will move further upward whereupon the second spring 17 will be compressed and the radial holes 13 in the valve body 8 will be uncovered towards the part 14 on the rod 7. This position is shown in FIG. 4. Liquid can then flow from the connection conduit 4 in through the radial holes 13 downward past the second spring 17 and out through the drainage conduit 12. The dimension and the number of holes 13 and the flow resistance in the secondary valve must be such that the pressure does not reach zero but is only somewhat decreased when the main control valve is closed.

It is important that the rod 7 seals with a tight gliding fit against the cavity of the valve body 8 so that when the holes 13 are located against the rod 17 no passage exists for the liquid. That part of the rod 7 which is located immediately above the part 14 must therefore have a smallest length of 1–2 mm so that a sealing can occur, but this part of the rod should not be too long since it should mean a too long lifting of the rod 7 to uncover the holes 13.

The lower part 15 of the rod 7 has partly plane polished surfaces, so that passage for the flowing fuel between this part and the valve body 8 exists.

FIG. 5 shows another embodiment of the invention. The reference numerals 4–17 in this figure relate to the same element as in the earlier figures. The difference between this embodiment and the one according to FIGS. 3 and 4 is that the holes 13 face towards a ring-shaped chamber 18 on the inner side of the valve body 8 and around the rod 7. The lower part of the ring-shaped chamber 13 is shaped as a valve seat and the rod 7 is shaped with an edge against this valve seat so that when the rod 7 is in its lower position the chamber 18 is closed at its bottom. To open the chamber 18 so that liquid may flow out therethrough, the rod 7 must be slightly lifted. In FIG. 5 the secondary valve is shown in its closed position and the main control valve in its open position, i.e. the electromagnet is not activated.

By the method and the arrangements according to the present invention it has become possible to regulate the pressure of the liquid fuel and the amount of injection thereof in a more accurate way than earlier. The means for bringing about this great advantage is the provision of the secondary valve and the possibility to be able to influence both the valves by two different levels of the electric current to the electromagnet. This switching on of the electric current occurs automatically and it is easy to regulate it by means of the trigger unit of the engine.

No substantial reconstruction of earlier known constructions without secondary valves is necessary with the construction according to the present invention. The valve body in the main control valve is substantially the same as with earlier constructions, but a central hole has to be made to allow the rod to be moved in the cavity. It is very important that the rod has a tight sliding fit compared to the valve body so that the secondary valve seals properly in its closed position. It is also important that the two springs are co-axial so that no side forces arise which could lock the secondary valve when the electromagnet is activated in two steps.

The invention is not limited to the embodiment shown but can be varied in different ways within the scope of the claims. Thus, the radial holes 13 may for example consist of elongated slots or non-round holes instead of drilled round holes.

What is claimed is:

1. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve having open and closed positions for maintaining said pressure during injecting of said fuel when said primary control valve is in said closed position, and a secondary control valve associated with said primary control valve, said secondary control valve having open and closed positions for relieving at least a portion of said pressure during said predetermined portion of said injecting of said fuel when said secondary control valve is in said open position, wherein said primary control valve comprises a housing, and including a movable valve body movable within said housing between open and closed positions, a first spring member for urging said movable valve body into said closed position, and an electromagnet for urging said movable valve body into said open position upon actuation of said electromagnet, and wherein said movable valve body includes an outer surface and an inner channel, said secondary control valve comprising a movable rod movably disposed within said inner channel of said movable valve body, said movable rod including a first end and a second end, said movable valve body including at least one aperture extending between said outer surface and said inner channel, said movable rod being movable within said inner channel between a first position wherein said movable rod blocks flow through said at least one aperture and a second position wherein said movable rod does not block flow through said at least one aperture, said first end of said movable rod being disposed at a position proximate to said electromagnet, a second spring member disposed between said second end of said movable rod and said movable valve body for urging said movable rod into said first position, said first spring member having a first stiffness and said second spring member having a second stiffness, said second stiffness being greater than said first stiffness whereby actuation of said electromagnet can urge said movable valve body into said closed position and further activation of said electromagnet can urge said movable valve body into said second position.

2. The apparatus of claim 1 wherein said movable rod includes a narrow rod region thereby providing clearance between said narrow rod region and said inner channel whereby said second position of said movable rod comprises said narrow rod region being juxtaposed with said at least one aperture.

3. The apparatus of claim 1 wherein said movable valve includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

4. The apparatus of claim 1 including a fuel store and an outlet for said control valve thereby permitting the flow of fuel through said control valve when either said primary control valve or said secondary control valve is in said open position, said outlet connected to said fuel store.

5. The apparatus of claim 1 wherein said first spring member is disposed between said movable valve body and said housing.

6. The apparatus of claim 1 wherein said first and second spring members are coaxial.

7. The apparatus of claim 1 wherein said movable valve body includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

8. The apparatus of claim 1 wherein said injector means comprises a piston.

9. The apparatus of claim 1 wherein said fuel comprises a diesel fuel.

10. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve is in said closed position, said primary control valve including a housing and a movable valve body movable within said housing between open and closed positions, a first spring member for urging said movable valve body into said closed position, and a secondary control valve associated with said primary control valve, said secondary control valve having open and closed positions for relieving at least a portion of said pressure during said predetermined portion of said injecting of said fuel when said secondary control valve is in said open position, said movable valve body including an outer surface and an inner channel, said secondary control valve including a movable rod movably disposed within said inner channel of said movable valve body, said movable rod including a first end and a second end, said movable rod being movable within said inner channel between a first position and a second position, and a second spring member disposed between said second end of said movable rod and said movable valve body for urging said movable rod into said first position, said first spring member having a first stiffness and said second spring member having a second stiffness, the second stiffness being greater than the first stiffness.

* * * * *

UNITED STATES PATENT AND TRADEMARK OFFICE

CERTIFICATE OF CORRECTION

PATENT NO. : 6,279,542 B1
DATED : August 28, 2001
INVENTOR(S) : Jan Lindblom

It is certified that error appears in the above-identified patent and that said Letters Patent is hereby corrected as shown below:

Delete specification, cols. 1-8 and substitute therefore specification, cols. 1-8 as shown on the attached pages.

Signed and Sealed this

Twentieth Day of April, 2004

JON W. DUDAS
*Acting Director of the United States Patent and Trademark Office*

METHOD AND ARRANGEMENT FOR CONTROLLING THE INJECTION PRESSURE OF LIQUID FUEL

TECHNICAL FIELD

The present invention relates to a method and an arrangement for controlling the pressure when injecting fuel, such as diesel oil, in an engine, whereby the pressure in a conventional way is obtained by a piston which is driven by a cam shaft and which presses oil out through a nozzle connected to a cylinder cavity in which the piston works. The spray nozzle is provided with small narrow holes through which the liquid fuel is atomized.

PRIOR ART

Many different arrangements for injecting diesel oil are known hitherto. They differ substantially from each other but have in common that a high pressure must be obtained so that the liquid is atomized and that the injection must occur quickly and start at a predetermined moment and be completed at a predetermined limited moment. Most arrangements are therefore based on the principle that a piston presses the fuel against a nozzle having holes at such high speed that a pressure of in the order of amount 300 Bar is created, whereby the injection of the fuel starts. This can occur by making the injection holes so small that they cannot allow all fuel which is pressed against them to pass. The pressure continues to rise even though fuel is flowing out from the nozzle. To release the pressure a connection between the pressure chamber and a valve is arranged, which valve opens when the injection is to be completed so that the pressure instantaneously drops to a zero value. The oil which flows through this regulating valve when it is opened flows via a drainage pipe back to the oil store.

The regulating valve is usually actuated by an electromagnet. It is of great importance that this valve works instantaneously since the whole injection cycle takes only time of in the order of 3 ms (milliseconds) having a highest pressure of about 1500 Bar.

The pressure-creating device, usually a piston in a cylinder, has usually a simple construction and the variations of the fuel injection arrangements which are present relate mostly to the controlling or steering valve which is connected to the fuel pressure. Examples of such arrangements are described in the German patent specification 3741526, the international patent application WO. 89/00242, the European patent specification 0193788 and the American patent specification 5517973. All these patent descriptions describe quite different arrangements and it is therefore difficult to compare them with each other and with other prior art.

The Technical Problem

In the known arrangements having only one controlling valve the fuel pressure is built up quickly to a value of in the order of 300 Bar and it increases thereafter to about 1500 Bar until the pressure is released by means of the control valve. The injection through the injection holes starts at about 300 Bar. At the beginning of the injection cycle the fuel is combusted with relatively large formation of nitrogen oxides ($NO_x$), which from an environmental view is a disadvantage. Since the content of nitrogen oxides is limited by law, which law is continually made more stringent the moment of injection and thus the combustion must normally be postponed to reduce the contamination. This postponement has a negative influence on the efficiency of the engine. A further disadvantage with known arrangements is that at high speeds the pressure can be built up too quickly and become too high above the limit which the injection construction allows. It is therefore a requirement to be able to influence the pressure or to relieve it somewhat during the injection cycle at chosen moments, such as at the beginning, in order to decrease the $NO_x$ emission and at the end to avoid too high pressures.

The Solution

According to the present invention, the above problem has been solved by a control valve which only closes and opens and an arrangement and a way of regulating the injection pressure of liquid fuel, such as diesel oil, by a nozzle having narrowed injection openings has been brought about, the pressure being created by a quick action from, for example, a piston in a cylinder and a main control valve in connection with the liquid fuel before the nozzle, which main control valve is kept closed during the injection, which method is characterized in that the pressure is relieved at a suitable moment during the injection cycle through a secondary valve.

According to the invention, it is suitable that the injection pressure is relieved at the beginning of the injection cycle for decreasing developed nitrous gases ($NO_x$) during combustion.

According to the invention, it may also be suitable that the injection pressure is relieved at the end of the injection cycle to allow higher speeds of the pressure-creating piston or the like.

The invention also comprises an arrangement for regulating the injection pressure of liquid fuel such as diesel oil by a nozzle having narrowed injection openings, whereby the pressure is created by a quick action from, for example, a piston in a cylinder and control valve in connection with the liquid fuel before the nozzle, which main control valve is kept closed during the injection, which arrangement is characterized in that a secondary valve within the main control cylinder for relieving the injection pressure.

According to the invention, the main control valve comprises a moveable valve body, which through an electromagnet, can be moved up and down against a first spring force having an enlargement at its lower part which is intended to co-operate with a surrounding housing to create a valve which can be closed or opened for the flow of liquid between the housing and the valve body, which liquid-flow is connected to the liquid before the liquid injection nozzle, which arrangement is characterized by a moveable rod within the valve body which is attached to the up and down moveable part of the electromagnet and which at its other end carries a second spring abutting against the lower part of the valve body, which second spring is stiffer than the first spring acting on the valve body, wherein radial holes have been made in the valve body inwardly against the rod and in that the rod co-operates with the valve body to make a valve.

According to the invention it is suitable that the radial holes in the valve body are located somewhat above the edge where a narrowing in the rod starts so that passage of liquid through the holes is prevented when the rod is located in its lower position with the stiffer second spring expanded.

It is also possible according to the invention that the radial holes in the valve body end in a ring-shaped part in the valve body around the rod and that the lower part of ring-shaped part and a circular edge delimiting a narrowing of the rod make a valve.

According to the invention, it is suitable that the outlet side for the flow in both the main valve and the secondary valve drain into the fuel store.

According to the invention, it is suitable that the first spring acting on the valve body abuts with its other end via a support against the upper side of the body and with its second end against a part of the housing.

According to the invention, both springs are suitably co-axial and the electromagnet is arranged to be activated in at least two steps, whereby in the first step the main control valve is closed and in the second step when the main control valve is closed the secondary control valve is opened.

FIGURE DESCRIPTION

The invention will in the following be described more in detail in connection with the enclosed drawings where FIG. 1 schematically shows an injection arrangement for fuel with a control valve of known kind, where FIG. 2 shows the same arrangement with the control valve in another position, where FIG. 3 shows the control arrangement according to the present invention having an open main control valve and a closed secondary valve, where FIG. 4 shows the same arrangement as according to FIG. 3 but with a closed main valve and an open secondary valve and where FIG. 5 shows another embodiment of the control valve according to the present invention having an open main control valve and a closed secondary valve.

DETAILED DESCRIPTION

FIG. 1 shows schematically a fuel injection device according to the prior art having a piston 1 which is forced down into a cylinder 2 in which the liquid fuel is present. The approximate piston stroke can be in the region of 15–17 mm. It is accordingly a question of very small and quick movements of the piston 1 which usually are activated from the cam shaft. From the cylinder cavity a conduit 3 leads to the injection nozzle. This comprises usually a wart-like device having for, example, eight injection holes with a diameter of 0.2 mm.

From the injection conduit 3 a branch conduit 4 leads to a control valve which is denoted throughout with the reference numeral 5. This is influenced by an electromagnet 6 having an upper stationary part and an under part being moveable upwards and downwards. From this lower moveable part a rod 7 extends downwardly and a valve body 8 is connected to this rod 7. Around the valve body 8 a housing 9 is arranged and this housing 9 is shaped with a valve seat 10 which, together with the body 8, forms a valve. The valve body 8 is kept in the downwardly pressed position by means of a first spring 11. However, when the electromagnet is activated the valve body 8 is lifted and the valve is closed.

When the fuel shall be injected into the engine through the nozzle from the fuel conduit 3, this control valve must be closed. If not, no pressure in the conduit 3 can be built up and the fuel takes the route through the control valve and out through the drainage conduit 12.

Below the schematic construction drawing of the injection arrangement the force influence from the electromagnet is shown first in FIG. 1B. The influence is as appears from the start 0, but at the point A the electromagnet is activated and it is kept activated by an even force until the point B when it again is deactivated.

In FIG. 1C the resulting injection pressure is shown. As appears from the figure, this pressure is practically 0 at the beginning, but it first builds up to the point C when it obtains a value of about 300 Bar when the injection starts through the holes in the nozzle, as a result of which the curve is given a push downward to thereafter continue up to the point D where the pressure can receive a value of about 1500 Bar. At the point D the electromagnet is deactivated and the pressure sinks quickly down to a very small value. When the pressure has come down, the injection will accordingly cease through the nozzle and the remaining pressure brings about only a flow through the open valve and the drainage conduit 12 to the fuel storage.

FIG. 2 shows the same arrangement as the one according to FIG. 1, but in this case the control valve is open and the fuel flow will then go, as appears from the figure, via the connecting conduit 4 and the open valve 8, 10 through the drainage conduit 12. No injection will occur in this case.

FIG. 3 shows a control valve according to the present invention where the denotations 4–12 relate to the same elements as in FIGS. 1 and 2. What distinguishes this figure from FIGS. 1 and 2 is that radial holes 13 are made in the valve body 8, which holes face towards the cylindrical rod 7. Additionally, the cylindric rod 7 has been made narrowing at the part 14 below the level for the radial holes 13 and the lowest part 15 of the rod 7 has been provided with plane surfaces so that liquid can flow between this lower part of the rod 7 and the hollow valve body 8. The lowermost part 16 of the rod 7, which is a plate, carries a second spring 17 which at its other end abuts against a plane underside of the valve body 8. This second spring 17 is stiffer than the first spring 11 between the valve body 8 and the housing 9. The valve body 8 is provided at its lower part with a pressed in plate 19 which preloads the spring 17 and determines the basic position for the rod 7.

The housing 9 is provided below the valve with an abutment 20 which makes a stop for the valve and which, through its position, determines the basic position of the valve in its opened position.

In the position which the figure shows, the secondary valve, i.e. the valve which consists of the rod 7 against the valve body 8, is closed whereas the main valve is open and the fuel liquid can therefore flow past the main valve and out through the drainage opening 12.

When the electromagnet 6 is activated, the lower part thereof will be pulled against the upper stationary part which means that it, together with the rod 7, will be pulled upwardly. Since the first spring 11 is weaker than the second spring 17, the spring 11 will thereby be compressed until the valve body 8 has abutted against the valve seat 10 on the housing 9 and accordingly closed the main control valve. On further stronger activation of the electromagnet, the rod 7 will move further upward whereupon the second spring 17 will be compressed and the radial holes 13 in the valve body 8 will be uncovered towards the part 14 on the rod 7. This position is shown on FIG. 4. Liquid can then flow from the connection conduit 4 in through the radial holes 13 downward past the second spring 17 and out through the drainage conduit 12. The dimension and the number of holes 13 and the flow resistance in the secondary valve must be such that the pressure does not reach zero but is only somewhat decreased when the main control valve is closed.

It is important that the rod 7 seals with a tight gliding fit against the cavity of the valve body 8 so that when the holes 13 are located against the rod 17 no passage exists for the liquid. That part of the rod 7 which is located immediately pressure during injecting of said fuel when said primary control valve is in said closed position, said primary control valve including a housing and a movable valve body movable within said housing between open and closed positions, a first spring member for urging said movable valve body into said closed position, and a secondary control valve associated with said primary control valve, said secondary control valve having open and closed positions for relieving at least a portion of said pressure during said predetermined portion of said injecting of said fuel when said secondary control valve is in said open position, said movable valve body including an outer surface and an inner channel, said secondary control valve including a movable rod movably disposed within said inner channel of said movable valve body, said movable rod including a first end and a second end, said movable rod being movable within said inner channel between a first position and a second position, and a second spring member disposed between said second end of said movable rod and said movable valve body for urging said movable rod into said first position, said first spring member having a first stiffness and said second spring member having a second stiffness, the second stiffness being greater than the first stiffness.

* * * * *

UNITED STATES PATENT AND TRADEMARK OFFICE

CERTIFICATE OF CORRECTION

PATENT NO. : 6,279,542 B1
DATED : August 28, 2001
INVENTOR(S) : Jan Lindblom

It is certified that error appears in the above-identified patent and that said Letters Patent is hereby corrected as shown below:

Delete specification, cols. 1-8 and substitute therefore specification, cols. 1-8 as shown on the attached pages.

This certificate supersedes Certificate of Correction issued April 20, 2004.

Signed and Sealed this

Tenth Day of August, 2004

JON W. DUDAS
*Acting Director of the United States Patent and Trademark Office*

METHOD AND ARRANGEMENT FOR CONTROLLING THE INJECTION PRESSURE OF LIQUID FUEL

TECHNICAL FIELD

The present invention relates to a method and an arrangement for controlling the pressure when injecting fuel, such as diesel oil, in an engine, whereby the pressure in a conventional way is obtained by a piston which is driven by a cam shaft and which presses oil out through a nozzle connected to a cylinder cavity in which the piston works. The spray nozzle is provided with small narrow holes through which the liquid fuel is atomized.

PRIOR ART

Many different arrangements for injecting diesel oil are known hitherto. They differ substantially from each other but have in common that a high pressure must be obtained so that the liquid is atomized and that the injection must occur quickly and start at a predetermined moment and be completed at a predetermined limited moment. Most arrangements are therefore based on the principle that a piston presses the fuel against a nozzle having holes at such high speed that a pressure of in the order of amount 300 Bar is created, whereby the injection of the fuel starts. This can occur by making the injection holes so small that they cannot allow all fuel which is pressed against them to pass. The pressure continues to rise even though fuel is flowing out from the nozzle. To release the pressure a connection between the pressure chamber and a valve is arranged, which valve opens when the injection is to be completed so that the pressure instantaneously drops to a zero value. The oil which flows through this regulating valve when it is opened flows via a drainage pipe back to the oil store.

The regulating valve is usually actuated by an electromagnet. It is of great importance that this valve works instantaneously since the whole injection cycle takes only time of in the order of 3 ms (milliseconds) having a highest pressure of about 1500 Bar.

The pressure-creating device, usually a piston in a cylinder, has usually a simple construction and the variations of the fuel injection arrangements which are present relate mostly to the controlling or steering valve which is connected to the fuel pressure. Examples of such arrangements are described in the German patent specification 3741526, the international patent application WO. 89/00242, the European patent specification 0193788 and the American patent specification 5517973. All these patent descriptions describe quite different arrangements and it is therefore difficult to compare them with each other and with other prior art.

The Technical Problem

In the known arrangements having only one controlling valve the fuel pressure is built up quickly to a value of in the order of 300 Bar and it increases thereafter to about 1500 Bar until the pressure is released by means of the control valve. The injection through the injection holes starts at about 300 Bar. At the beginning of the injection cycle the fuel is combusted with relatively large formation of nitrogen oxides ($NO_x$), which from an environmental view is a disadvantage. Since the content of nitrogen oxides is limited by law, which law is continually made more stringent the moment of injection and thus the combustion must normally be postponed to reduce the contamination. This postponement has a negative influence on the efficiency of the engine. A further disadvantage with known arrangements is that at high speeds the pressure can be built up too quickly and become too high above the limit which the injection construction allows. It is therefore a requirement to be able to influence the pressure or to relieve it somewhat during the injection cycle at chosen moments, such as at the beginning, in order to decrease the $NO_x$ emission and at the end to avoid too high pressures.

The Solution

According to the present invention, the above problem has been solved by a control valve which only closes and opens and an arrangement and a way of regulating the injection pressure of liquid fuel, such as diesel oil, by a nozzle having narrowed injection openings has been brought about, the pressure being created by a quick action from, for example, a piston in a cylinder and a main control valve in connection with the liquid fuel before the nozzle, which main control valve is kept closed during the injection, which method is characterized in that the pressure is relieved at a suitable moment during the injection cycle through a secondary valve.

According to the invention, it is suitable that the injection pressure is relieved at the beginning of the injection cycle for decreasing developed nitrous gases ($NO_x$) during combustion.

According to the invention, it may also be suitable that the injection pressure is relieved at the end of the injection cycle to allow higher speeds of the pressure-creating piston or the like.

The invention also comprises an arrangement for regulating the injection pressure of liquid fuel such as diesel oil by a nozzle having narrowed injection openings, whereby the pressure is created by a quick action from, for example, a piston in a cylinder and control valve in connection with the liquid fuel before the nozzle, which main control valve is kept closed during the injection, which arrangement is characterized in that a secondary valve within the main control cylinder for relieving the injection pressure.

According to the invention, the main control valve comprises a moveable valve body, which through an electromagnet, can be moved up and down against a first spring force having an enlargement at its lower part which is intended to co-operate with a surrounding housing to create a valve which can be closed or opened for the flow of liquid between the housing and the valve body, which liquid-flow is connected to the liquid before the liquid injection nozzle, which arrangement is characterized by a moveable rod within the valve body which is attached to the up and down moveable part of the electromagnet and which at its other end carries a second spring abutting against the lower part of the valve body, which second spring is stiffer than the first spring acting on the valve body, wherein radial holes have been made in the valve body inwardly against the rod and in that the rod co-operates with the valve body to make a valve.

According to the invention it is suitable that the radial holes in the valve body are located somewhat above the edge where a narrowing in the rod starts so that passage of liquid through the holes is prevented when the rod is located in its lower position with the stiffer second spring expanded.

It is also possible according to the invention that the radial holes in the valve body end in a ring-shaped part in the valve body around the rod and that the lower part of ring-shaped part and a circular edge delimiting a narrowing of the rod make a valve.

According to the invention, it is suitable that the outlet side for the flow in both the main valve and the secondary valve drain into the fuel store.

According to the invention, it is suitable that the first spring acting on the valve body abuts with its other end via a support against the upper side of the body and with its second end against a part of the housing.

According to the invention, both springs are suitably co-axial and the electromagnet is arranged to be activated in at least two steps, whereby in the first step the main control valve is closed and in the second step when the main control valve is closed the secondary control valve is opened.

FIGURE DESCRIPTION

The invention will in the following be described more in detail in connection with the enclosed drawings where FIG. 1 schematically shows an injection arrangement for fuel with a control valve of known kind, where FIG. 2 shows the same arrangement with the control valve in another position, where FIG. 3 shows the control arrangement according to the present invention having an open main control valve and a closed secondary valve, where FIG. 4 shows the same arrangement as according to FIG. 3 but with a closed main valve and an open secondary valve and where FIG. 5 shows another embodiment of the control valve according to the present invention having an open main control valve and a closed secondary valve.

DETAILED DESCRIPTION

FIG. 1 shows schematically a fuel injection device according to the prior art having a piston 1 which is forced down into a cylinder 2 in which the liquid fuel is present. The approximate piston stroke can be in the region of 15–17 mm. It is accordingly a question of very small and quick movements of the piston 1 which usually are activated from the cam shaft. From the cylinder cavity a conduit 3 leads to the injection nozzle. This comprises usually a wart-like device having for, example, eight injection holes with a diameter of 0.2 mm.

From the injection conduit 3 a branch conduit 4 leads to a control valve which is denoted throughout with the reference numeral 5. This is influenced by an electromagnet 6 having an upper stationary part and an under part being moveable upwards and downwards. From this lower moveable part a rod 7 extends downwardly and a valve body 8 is connected to this rod 7. Around the valve body 8 a housing 9 is arranged and this housing 9 is shaped with a valve seat 10 which, together with the body 8, forms a valve. The valve body 8 is kept in the downwardly pressed position by means of a first spring 11. However, when the electromagnet is activated the valve body 8 is lifted and the valve is closed.

When the fuel shall be injected into the engine through the nozzle from the fuel conduit 3, this control valve must be closed. If not, no pressure in the conduit 3 can be built up and the fuel takes the route through the control valve and out through the drainage conduit 12.

Below the schematic construction drawing of the injection arrangement the force influence from the electromagnet is shown first in FIG. 1B. The influence is as appears from the start 0, but at the point A the electromagnet is activated and it is kept activated by an even force until the point B when it again is deactivated.

In FIG. 1C the resulting injection pressure is shown. As appears from the figure, this pressure is practically 0 at the beginning, but it first builds up to the point C when it obtains a value of about 300 Bar when the injection starts through the holes in the nozzle, as a result of which the curve is given a push downward to thereafter continue up to the point D where the pressure can receive a value of about 1500 Bar. At the point D the electromagnet is deactivated and the pressure sinks quickly down to a very small value. When the pressure has come down, the injection will accordingly cease through the nozzle and the remaining pressure brings about only a flow through the open valve and the drainage conduit 12 to the fuel storage.

FIG. 2 shows the same arrangement as the one according to FIG. 1, but in this case the control valve is open and the fuel flow will then go, as appears from the figure, via the connecting conduit 4 and the open valve 8, 10 through the drainage conduit 12. No injection will occur in this case.

FIG. 3 shows a control valve according to the present invention where the denotations 4–12 relate to the same elements as in FIGS. 1 and 2. What distinguishes this figure from FIGS. 1 and 2 is that radial holes 13 are made in the valve body 8, which holes face towards the cylindrical rod 7. Additionally, the cylindric rod 7 has been made narrowing at the part 14 below the level for the radial holes 13 and the lowest part 15 of the rod 7 has been provided with plane surfaces so that liquid can flow between this lower part of the rod 7 and the hollow valve body 8. The lowermost part 16 of the rod 7, which is a plate, carries a second spring 17 which at its other end abuts against a plane underside of the valve body 8. This second spring 17 is stiffer than the first spring 11 between the valve body 8 and the housing 9. The valve body 8 is provided at its lower part with a pressed in plate 19 which preloads the spring 17 and determines the basic position for the rod 7.

The housing 9 is provided below the valve with an abutment 20 which makes a stop for the valve and which, through its position, determines the basic position of the valve in its opened position.

In the position which the figure shows, the secondary valve, i.e. the valve which consists of the rod 7 against the valve body 8, is closed whereas the main valve is open and the fuel liquid can therefore flow past the main valve and out through the drainage opening 12.

When the electromagnet 6 is activated, the lower part thereof will be pulled against the upper stationary part which means that it, together with the rod 7, will be pulled upwardly. Since the first spring 11 is weaker than the second spring 17, the spring 11 will thereby be compressed until the valve body 8 has abutted against the valve seat 10 on the housing 9 and accordingly closed the main control valve. On further stronger activation of the electromagnet, the rod 7 will move further upward whereupon the second spring 17 will be compressed and the radial holes 13 in the valve body 8 will be uncovered towards the part 14 on the rod 7. This position is shown on FIG. 4. Liquid can then flow from the connection conduit 4 in through the radial holes 13 downward past the second spring 17 and out through the drainage conduit 12. The dimension and the number of holes 13 and the flow resistance in the secondary valve must be such that the pressure does not reach zero but is only somewhat decreased when the main control valve is closed.

It is important that the rod 7 seals with a tight gliding fit against the cavity of the valve body 8 so that when the holes 13 are located against the rod 17 no passage exists for the liquid. That part of the rod 7 which is located immediately above the part 14 must therefore have a smallest length of 1–2 mm so that a sealing can occur, but this part of the rod should not be too long since it should mean a too long lifting of the rod 7 to uncover the holes 13.

The lower part 15 of the rod 7 has partly plane polished surfaces, so that passage for the flowing fuel between this part and the valve body 8 exists.

FIG. 5 shows another embodiment of the invention. The reference numerals 4–17 in this figure relate to the same element as in the earlier figures. The difference between this embodiment and the one according to FIGS. 3 and 4 is that the holes 13 face towards a ring-shaped chamber 18 on the inner side of the valve body 8 and around the rod 7. The lower part of the ring-shaped chamber 13 is shaped as a valve seat and the rod 7 is shaped with an edge against this valve seat so that when the rod 7 is in its lower position the chamber 18 is closed at its bottom. To open the chamber 18 so that liquid may flow out therethrough, the rod 7 must be slightly lifted. In FIG. 5 the secondary valve is shown in its closed position and the main control valve in its open position, i.e. the electromagnet is not activated.

By the method and the arrangements according to the present invention it has become possible to regulate the pressure of the liquid fuel and the amount of injection thereof in a more accurate way than earlier. The means for bringing about this great advantage is the provision of the secondary valve and the possibility to be able to influence both the valves by two different levels of the electric current to the electromagnet. This switching on of the electric current occurs automatically and it is easy to regulate it by means of the trigger unit of the engine.

No substantial reconstruction of earlier known constructions without secondary valves is necessary with the construction according to the present invention. The valve body in the main control valve is substantially the same as with earlier constructions, but a central hole has to be made to allow the rod to be moved in the cavity. It is very important that the rod has a tight sliding fit compared to the valve body so that the secondary valve seals properly in its closed position. It is also important that the two springs are co-axial so that no side forces arise which could lock the secondary valve when the electromagnet is activated in two steps.

The invention is not limited to the embodiment shown but can be varied in different ways within the scope of the claims. Thus, the radial holes 13 may for example consist of elongated slots or non-round holes instead of drilled round holes.

What is claimed is:

1. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve is in said closed position, and a secondary control valve associated with said primary control valve, said secondary control valve having open and closed positions for relieving at least a portion of said pressure during said predetermined portion of said injecting of said fuel when said secondary control valve is in said open position, wherein said primary control valve comprises a housing, and including a movable valve body movable within said housing between open and closed positions, a first spring member for urging said movable valve body into said closed position, and an electromagnet for urging said movable valve body into said open position upon actuation of said electromagnet, and wherein said movable valve body includes an outer surface and an inner channel, said secondary control valve comprising a movable rod movably disposed within said inner channel of said movable valve body, said movable rod including a first end and a second end, said movable valve body including at least one aperture extending between said outer surface and said inner channel, said movable rod being movable within said inner channel between a first position wherein said movable rod blocks flow through said at least one aperture and a second position wherein said movable rod does not block flow through said at least one aperture, said first end of said movable rod being disposed at a position proximate to said electromagnet, a second spring member disposed between said second end of said movable rod and said movable valve body for urging said movable rod into said first position, said first spring member having a first stiffness and said second spring member having a second stiffness, said second stiffness being greater than said first stiffness whereby actuation of said electromagnet can urge said movable valve body into said closed position and further activation of said electromagnet can urge said movable valve body into said second position.

2. The apparatus of claim 1 wherein said movable rod includes a narrow rod region thereby providing clearance between said narrow rod region and said inner channel whereby said second position of said movable rod comprises said narrow rod region being juxtaposed with said at least one aperture.

3. The apparatus of claim 1 wherein said movable valve body includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

4. The apparatus of claim 1 including a fuel store and an outlet for said control valve thereby permitting the flow of fuel through said control valve when either said primary control valve or said secondary control valve is in said open position, said outlet connected to said fuel store.

5. The apparatus of claim 1 wherein said first spring member is disposed between said movable valve body and said housing.

6. The apparatus of claim 1 wherein said first and second spring members are coaxial.

7. The apparatus of claim 1 wherein said movable valve body includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

8. The apparatus of claim 1 wherein said injector means comprises a piston.

9. The apparatus of claim 1 wherein said fuel comprises a diesel fuel.

10. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve is in said closed position, said primary control valve including a housing and a movable valve body movable within said housing between open and closed positions, a first spring member for urging said movable valve body into said closed position, and a secondary control valve associated with said primary control valve, said secondary control valve having open and closed positions for relieving at least a portion of said pressure during said predetermined portion of said injecting of said fuel when said secondary control valve is in said open position, said movable valve body including an outer surface and an inner channel, said secondary control valve including a movable rod movably disposed within said inner channel of said movable valve body, said movable rod including a first end and a second end, said movable rod being movable within said inner channel between a first position and a second position, and a second spring member disposed between said second end of said movable rod and said movable valve body for urging said movable rod into said first position, said first spring member having a first stiffness and said second spring member having a second stiffness, the second stiffness being greater than the first stiffness.

* * * * *

UNITED STATES PATENT AND TRADEMARK OFFICE

CERTIFICATE OF CORRECTION

PATENT NO. : 6,279,542 B1
DATED : August 28, 2001
INVENTOR(S) : Jan Lindblom

It is certified that error appears in the above-identified patent and that said Letters Patent is hereby corrected as shown below:

Delete specification, cols. 1-8 and substitute specification, cols. 1-8 as shown on the attached pages.

This certificate supersedes Certificate of Correction issued April 20, 2004 and August 10, 2004.

Signed and Sealed this

Twenty-eighth Day of February, 2006

JON W. DUDAS
*Director of the United States Patent and Trademark Office*

METHOD AND ARRANGEMENT FOR CONTROLLING THE INJECTION PRESSURE OF LIQUID FUEL

FIELD OF THE INVENTION

The present invention relates to a method and apparatus for controlling the pressure when injecting fuel, such as diesel oil, in an engine. More particularly, the present invention relates to such methods and apparatus in which the pressure is conventionally obtained by a piston driven by a cam shaft, and which forces oil through a nozzle connected to a cylinder cavity in which the piston operates.

BACKGROUND OF THE INVENTION

A variety of different arrangements are known for injecting diesel oil. They differ substantially from each other but have in common that a high pressure is required for the liquid to be atomized, and that the injection must occur rapidly and begin at a predetermined moment and be completed within a predetermined limited interval. Most of these arrangements are therefore based on the principle that a piston forces the fuel against a nozzle having holes at such a high speed that a pressure in the order of amount 300 Bar is created, whereby injection of the fuel starts. This can occur by making the injection holes so small that they cannot permit all of the fuel which is forced against them to pass therethrough. The pressure thus continues to rise even though fuel is flowing out of the nozzle. To release the pressure, a connection between the pressure chamber and a valve is provided for, which valve opens when the injection is to be completed so that the pressure instantaneously drops to a zero value. The oil which flows through this regulating valve when it is opened then flows through a drainage pipe back to the oil store.

The regulating valve is usually actuated by an electromagnet. It is important that this valve work instantaneously, since the entire injection cycle takes only in the order of 3 ms (milliseconds), having a maximum pressure of about 1500 Bar.

The pressure-creating device, which is usually a piston in a cylinder, usually has a simple construction, and the various fuel injection devices which are presently available mostly relate to the controlling or steering valve which is connected to the fuel pressure. Examples of such arrangements are described in the German Patent Specification No. 3,741,526, International Patent Application No. WO 89/00242, European Patent Specification No. 193,788, and U.S Pat. No. 5,517,973. All of these patents describe quite different arrangements, and it is therefore difficult to compare them with each other and with other prior art.

In these known devices having only one controlling valve, the fuel pressure builds up quickly to a value on the order of 300 Bar and it increases thereafter to about 1500 Bar until the pressure is released by means of the control valve. Injection through the injection holes begins at about 300 Bar. At the beginning of the injection cycle, the fuel is combusted with relatively large formation of nitrogen oxides ($NO_x$), which is a distinct disadvantage from an environmental view. Since the content of nitrogen oxides is limited by laws which are continually being made more stringent, the moment of injection, and thus of combustion, must normally be postponed to reduce such contamination. This delay has a negative influence on engine efficiency. A further disadvantage with these known devices is that at high speeds the pressure can build up too rapidly and become too high, or be above the limit of the injection construction. It is therefore necessary to be able to influence the pressure to relieve it to some extent during the injection cycle at selected times, such as at the beginning, in order to decrease $NO_x$ emissions, and at the end in order to avoid excessive pressures.

SUMMARY OF THE INVENTION

In accordance with the present invention, these and other problems have now been solved by the invention of a method for controlling the injection pressure for fuel through a nozzle for combustion in an engine comprising injecting the fuel at a predetermined injection pressure by means of an injector, maintaining the pressure during the injection of the fuel by closing a primary control valve for the fuel, and relieving at least a portion of the pressure during a predetermined portion of the injecting of the fuel. In accordance with the preferred embodiment of the present invention, the injector means comprises a piston.

In accordance with one embodiment of the method of the present invention, nitrous gases are produced during the combustion, and the predetermined portion of the injecting of the fuel comprises the beginning of the injecting of the fuel, whereby the nitrous gases are decreased.

In accordance with another embodiment of the method of the present invention, the predetermined portion of the injecting of the fuel comprises the end of the injecting of the fuel, whereby the injector can operate at higher speed.

In accordance with the present invention, apparatus has also been invented for controlling the injection pressure for fuel through a nozzle for combustion in an engine comprising injecting means for injecting the fuel at a predetermined injection pressure through the nozzle, a primary control valve having open and closed positions for maintaining the pressure during injecting of the fuel when the primary control valve is in the closed position, and a secondary control valve associated with the primary control valve, the secondary control valve having open and closed positions for relieving at least a portion of the pressure during the predetermined portion of the injecting of the fuel when the secondary control valve is in the open position. In a preferred embodiment, the injector means comprises a piston. In another embodiment, the fuel comprises a diesel fuel.

In accordance with one embodiment of the apparatus of the present invention, the primary control valve comprises a housing, and the apparatus includes a movable valve body movable within the housing between open and closed positions, a first spring member for urging the movable valve body into the closed position, and an electromagnet for urging the movable valve body into the open position upon actuation of the electromagnet.

In accordance with a preferred embodiment of the apparatus of the present invention, the movable valve body includes an outer surface and an inner channel, the secondary control valve comprises a movable rod movably disposed within the inner channel of the movable valve body, the movable rod including a first end and a second end, the movable valve body including at least one aperture extending between the outer surface and the inner channel, the movable rod being movable within the inner channel between a first position wherein the movable rod blocks the at least one aperture and a second position wherein the movable rod does not block the at least one aperture, the first end of the movable rod being disposed at a position proximate to the electromagnet, a second spring member disposed between the second end of the movable rod and the movable valve body for urging the movable rod into the first position, the first spring member having a first stiffness and the second spring member having a second stiffness, the second stiffness being greater than the first stiffness whereby actuation of the electromagnet can urge the movable valve body into the closed position and further activation of the electromagnet can urge the movable valve body into the second position.

In accordance with a preferred embodiment of the apparatus of the present invention, the movable rod includes a narrow rod region thereby providing clearance between the narrow rod region and the inner channel whereby the second position of the movable rod comprises the narrow rod region being juxtaposed with the at least one aperture.

In accordance with another embodiment of the apparatus of the present invention, the movable valve body includes an expanded region within the inner channel associated with the at least one aperture thereby providing clearance between the movable rod and the expanded region, the movable rod including a narrowed region thereby providing clearance between the narrowed region and the inner channel, whereby the second position of the movable rod comprises the narrowed region of the movable rod juxtaposed with the expanded region of the movable rod body.

In accordance with another embodiment of the apparatus of the present invention, the apparatus includes a fuel store and an outlet for the control valve thereby permitting the flow of fuel through the control valve when either the primary control valve or the secondary control valve is in the open position, the outlet connected to the fuel store.

In accordance with another embodiment of the apparatus of the present invention, the first spring member is disposed between the movable valve body and the housing.

In accordance with another embodiment of the apparatus of the present invention, the first and second spring members are coaxial.

According to the present invention, the above problems have been solved by a control valve which only closes and opens, and apparatus and a method of regulating the injection pressure of liquid fuel, such as diesel oil, by a nozzle having narrowed injection openings. In such method and apparatus, the pressure is created by a rapid action from, for example, a piston in a cylinder, and a main control valve in connection with the liquid fuel upstream of the nozzle, which main control valve is kept closed during the injection, in which method the pressure is relieved at a suitable moment during the injection cycle by means of a secondary valve.

According to the present invention, the injection pressure can be relieved at the beginning of the injection cycle for decreasing developed nitrous gases ($NO_x$) during combustion.

According to the present invention, it may also be suitable for the injection pressure to be relieved at the end of the injection cycle in order to allow for higher speeds of the pressure-creating piston or the like.

The present invention also comprises apparatus for regulating the injection pressure of liquid fuel, such as diesel oil, by a nozzle having narrowed injection openings, whereby the pressure is created by quick action from, for example, a piston in a cylinder, and a main control valve in connection with the liquid fuel upstream of the nozzle, which main control valve is kept closed during injection, which apparatus comprises a secondary valve within the main control valve cylinder for relieving the injection pressure.

According to the present invention, the main control valve comprises a movable valve body, which can be moved up and down by an electromagnet against a first spring force, and which has an enlargement at its lower end which is intended to cooperate with a surrounding housing to create a valve which can be closed or opened for the flow of liquid between the housing and the valve body, which liquid-flow communicates with the liquid upstream of the liquid injection nozzle, which apparatus comprises a movable rod within the valve body which is attached to the part of the electromagnet which is vertically movable and which at its other end carries a second spring abutting against the lower part of the valve body, which second spring is stiffer than the first spring acting on the valve body, whereby radial holes are included in the valve body inwardly against the rod, and in which the rod cooperates with the valve body to make a valve.

According to the present invention, it is suitable that the radial holes in the valve body are located slightly above the edge where a narrowing in the rod begins so that passage of liquid through the holes is prevented when the rod is located in its lower position, with the stiffer second spring expanded.

It is also possible according to the present invention that the radial holes in the valve body end in a ring-shaped portion in the valve body around the rod and that the lower portion of the ring-shaped part and a circular edge delimiting a narrowing of the rod make a valve.

According to the present invention, it is suitable that the outlet side for the flow in both the main valve and the secondary valve drain into the fuel store.

According to the present invention, it is suitable that the other end of the first spring acting on the valve body abuts by means of a support against the upper side of the body, and with its second end it abuts against a part of the housing.

According to the present invention, both springs are suitably co-axial and the electromagnet is arranged to be activated in at least two steps, whereby in the first step the main control valve is closed and in the second step when the main control valve is closed the secondary control valve is opened.

BRIEF DESCRIPTION OF THE DRAWINGS

The present invention will be more fully described in connection with the following detailed description, which refers to the enclosed drawings where.

DETAILED DESCRIPTION

Figure 1:
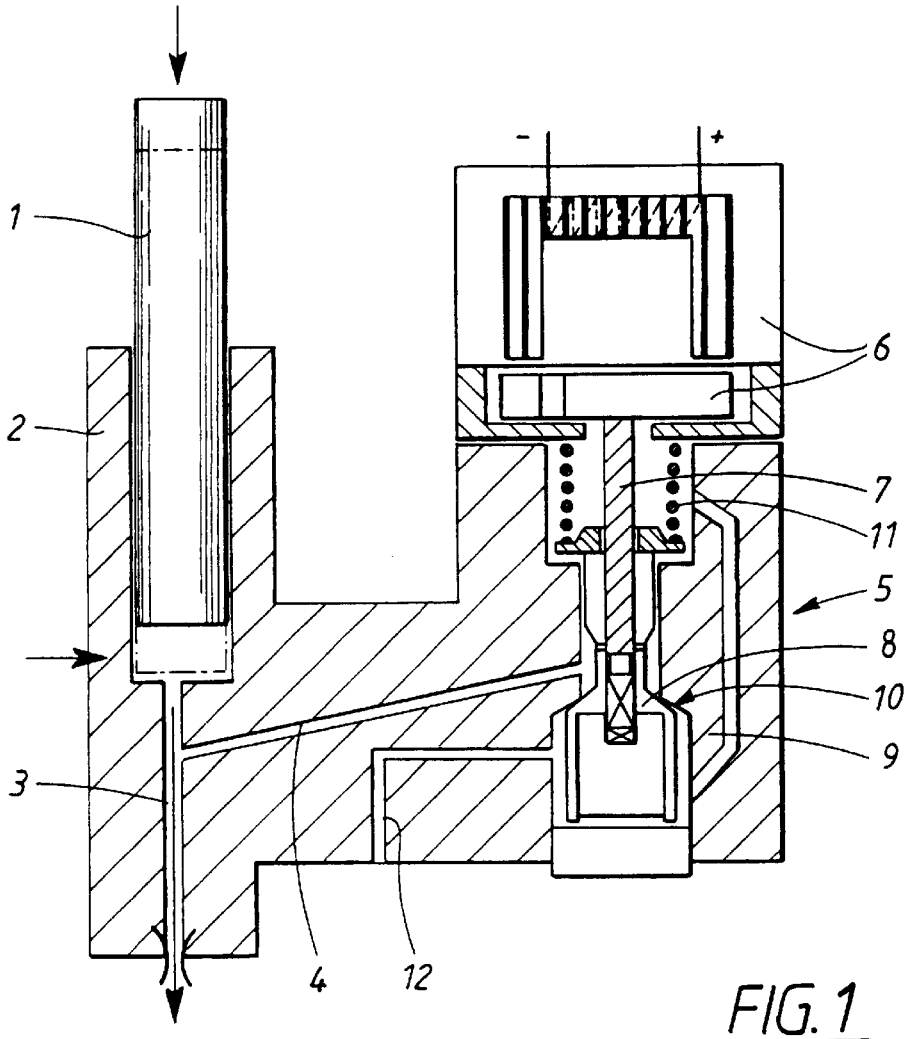
FIG. 1 (PRIOR ART)
FIG. 1 is a side, elevational, schematic view of an injection apparatus for fuel with a control valve of type known in the art.

Referring to the drawings, in which like reference numerals refer to like elements thereof, FIG. 1 shows a fuel injection device according to the prior art having a piston 1 which is forced down into a cylinder 2 in which the liquid fuel is present. The approximate piston stroke can be in the range of about 15–17 mm. It is therefore clear that very small and rapid movements of the piston 1 are activated from the cam shaft. From the cylinder cavity, a conduit 3 leads to the injection nozzle. This comprises a wart-like device having, for example, eight injection holes with a diameter of about 0.2 mm.

From the injection conduit 3, a branch conduit 4 leads to a control valve which is denoted throughout by reference numeral 5. This is influenced by an electromagnet 6 having an upper stationary portion and lower portion, and which is movable upwards and downwards. From this lower movable portion, a rod 7 extends downwardly and valve body 8 is connected to this rod 7. A housing is arranged around the valve body 8, and this housing 9 is shaped with a valve seat 10 which, together with the body 8, forms a valve. The valve body 8 is maintained in the downwardly pressed position by means of a first spring 11. However, when the electromagnet is activated, the valve body 8 is lifted and the valve is closed.

When the fuel is to be injected into the engine through the nozzle from the fuel conduit 3, this control valve must be closed. If not, no pressure can build up in the conduit 3 and the fuel takes the route through the control valve and out through the drainage conduit 12.

Figure 1B:
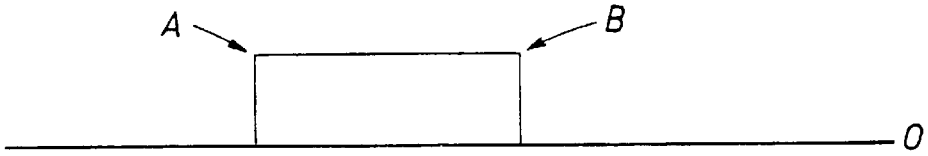
FIG. 1B is a graphical representation of the force applied by the electromagnet shown in FIG. 1.

The force influence produced by the electromagnet is shown first in FIG. 1B. The influence is thus shown to start at 0, but at point A the electromagnet is activated, and it is kept activated by an even force until point B, when it is again deactivated.

Figure 1C:
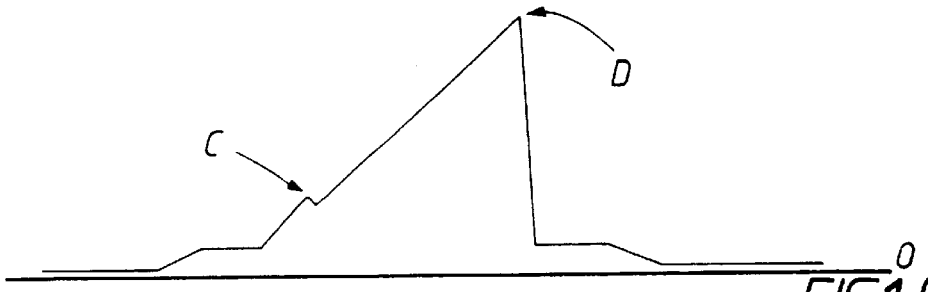
FIG. 1C is a graphical representation of the resulting injection pressure in the device shown in FIG. 1.

In FIG. 1C, the resulting injection pressure is shown. As appears from this figure, this pressure is practically 0 at the beginning, but it initially builds up to point C, when it obtains a value of about 300 Bar when the injection begins through the holes in the nozzle, as a result of which the curve begins downward, to thereafter continue up to point D where the pressure can achieve a value of about 1500 Bar. At point D, the electromagnet is deactivated, and the pressure decreases rapidly down to a very small value. When the pressure has come down, injection will accordingly cease through the nozzle and the remaining pressure brings about only a flow through the open valve and the drainage conduit 12 to the fuel storage.

Figure 2:
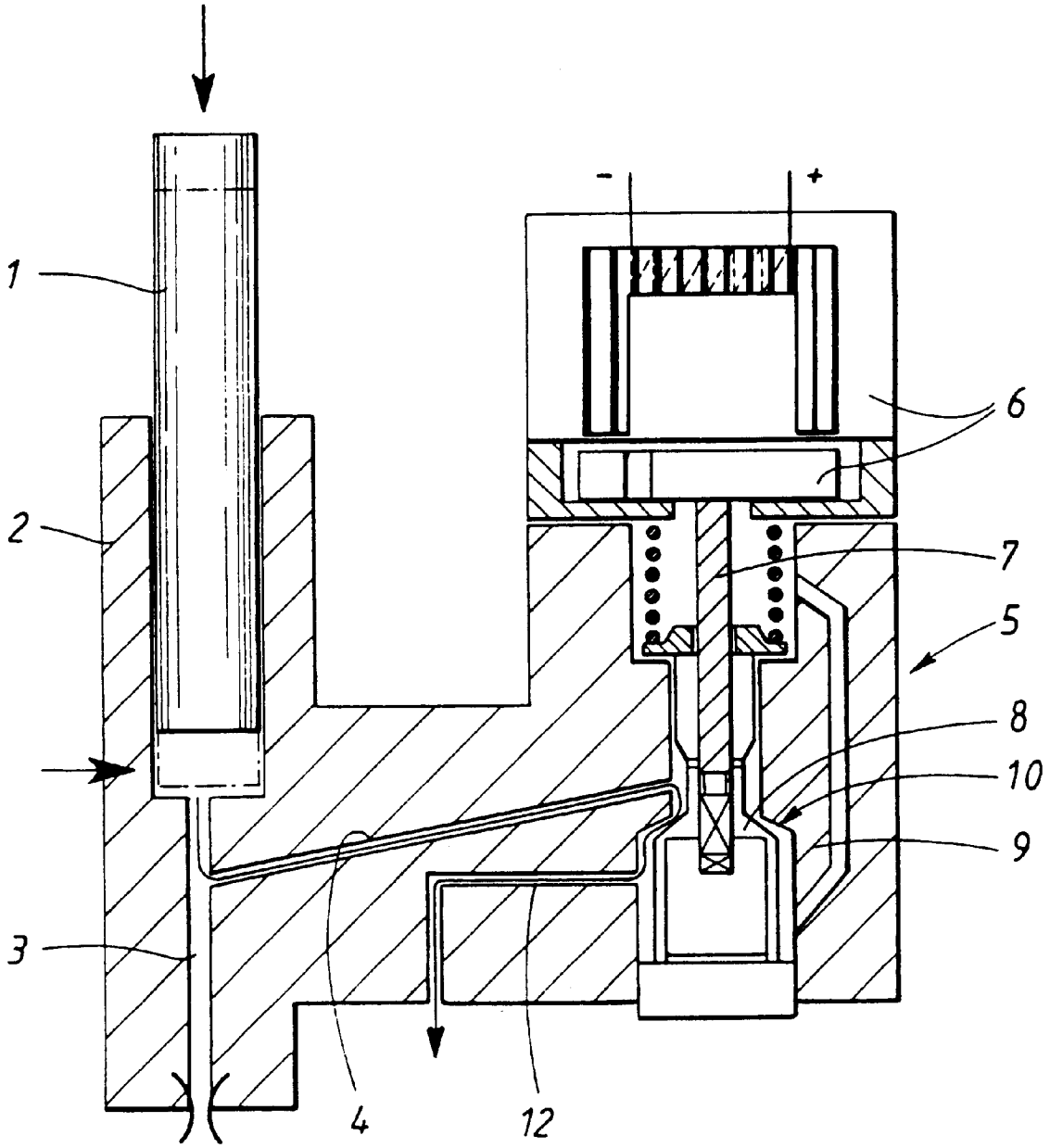
FIG. 2 (PRIOR ART)
FIG. 2 is a side, elevational, schematic view of the control valve shown in FIG. 1 in another position.

FIG. 2 shows the same apparatus as that shown in FIG. 1, but in this case the control valve is open and the fuel flow will then proceed through the connecting conduit 4 and the open valve 8, 10 through the drainage conduit 12. No injection will occur in this case.

Figure 3:
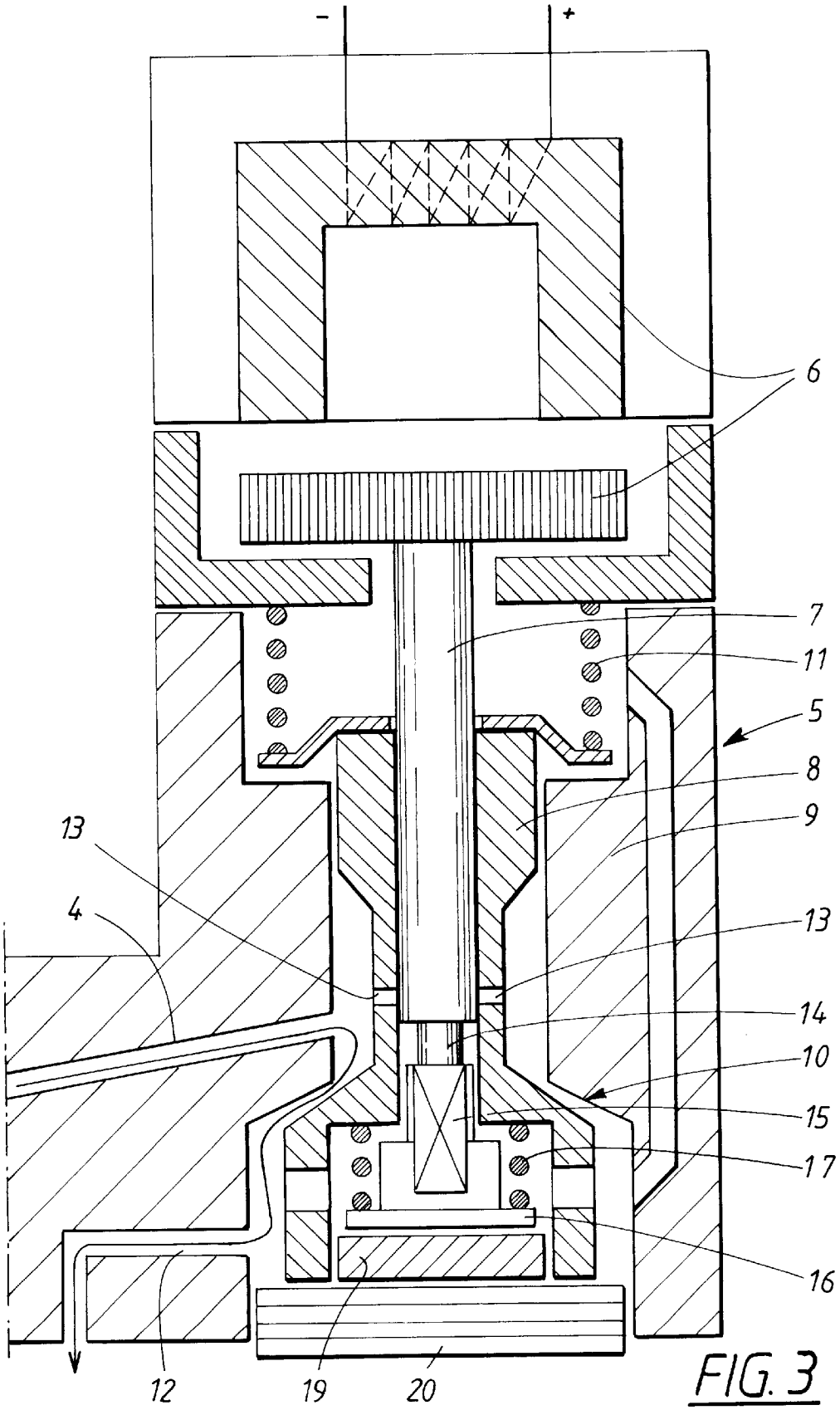
FIG. 3 is a side, elevational, partially sectional view of the control arrangement according to the present invention, having an open main control valve and a closed secondary valve.

FIG. 3 shows a control valve according to the present invention where reference numerals 4–12 relate to the same elements as in FIGS. 1 and 2. This figure is distinguished from FIGS. 1 and 2 in that radial holes 13 are made in the valve body 8, which holes face towards the cylindrical rod 7. Additionally, the cylindrical rod 7 has been narrowed at the portion 14 below the level of the radial holes 13, and the lowest part 15 of the rod 7 has been provided with planar surfaces so that liquid can flow between this lower part of the rod 7 and the hollow valve body 8. The lowermost portion 16 of the rod 7, which is a plate, carries a second spring 17 which at its other end abuts against a planar underside of the valve body 8. This second spring 17 is stiffer than the first spring 11 between the valve body 8 and the housing 9. The valve body 8 is provided at its lower portion with a pressed in plate 19 which preloads the spring 17 and determines the basic position for the rod 7.

Below the valve, housing 9 is provided with an abutment 20 which makes a stop for the valve and which, through its position, determines the basic position of the valve in its opened position.

In the position which the fixture shows, the secondary valve, i.e. the valve which consists of the rod 7 against the valve body 8, is closed, whereas the main valve is open and the fuel liquid can therefore flow past the main valve and out through drainage opening 12.

Figure 4:
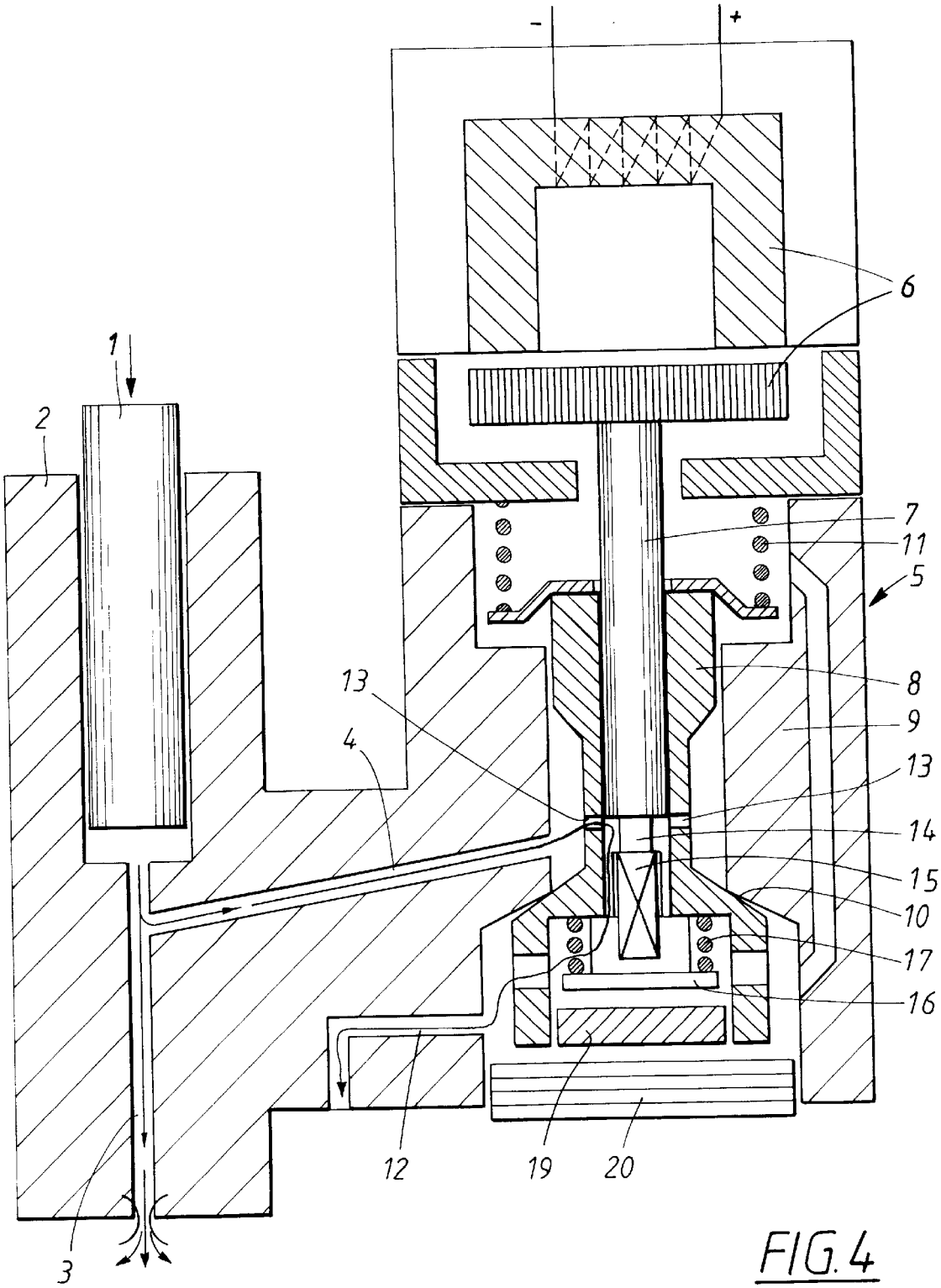
FIG. 4 is a side, elevational, partially sectional view of the arrangement shown in FIG. 3, but with a closed main valve and an open secondary valve.

When the electromagnet 6 is activated, the lower part of the valve body 8 will be pulled against the upper stationary part which, together with the rod 7, will be pulled upwardly. Since the first spring 11 is weaker than the second spring 17, the spring 11 will be compressed until the valve body 8 has abutted against the valve seat 10 on the housing 9 and accordingly closed the main control valve. On further stronger activation of the electromagnet, the rod 7 will move further upward, whereupon the second spring 17 will be compressed and the radial holes 13 in the valve body 8 will be uncovered towards the part 14 on the rod 7. This position is shown in FIG. 4. Liquid can then flow from the connection conduit 4 through the radial holes 13 downwardly past the second spring 17 and out through the drainage conduit 12. The dimensions and the number of holes 13 and the flow resistance in the secondary valve must be such that the pressure does not reach zero, but is only somewhat decreased when the main control valve is closed.

It is important that the rod 7 seals with a tight gliding fit against the cavity of the valve body 8 so that when the holes 13 are located against the rod 17 no passage exists for the liquid. That portion of the rod 7 which is located immediately above the part 14 must therefore have a short length of about 1–2 mm so that sealing can occur, but this part of the rod should not be too long, since this would reference too much lifting of the rod 7 to uncover the holes 13.

The lower part 15 of the rod 7 has partially planar polished surfaces, so that flowing fuel can pass between this part and valve body 8 exists.

Figure 5:
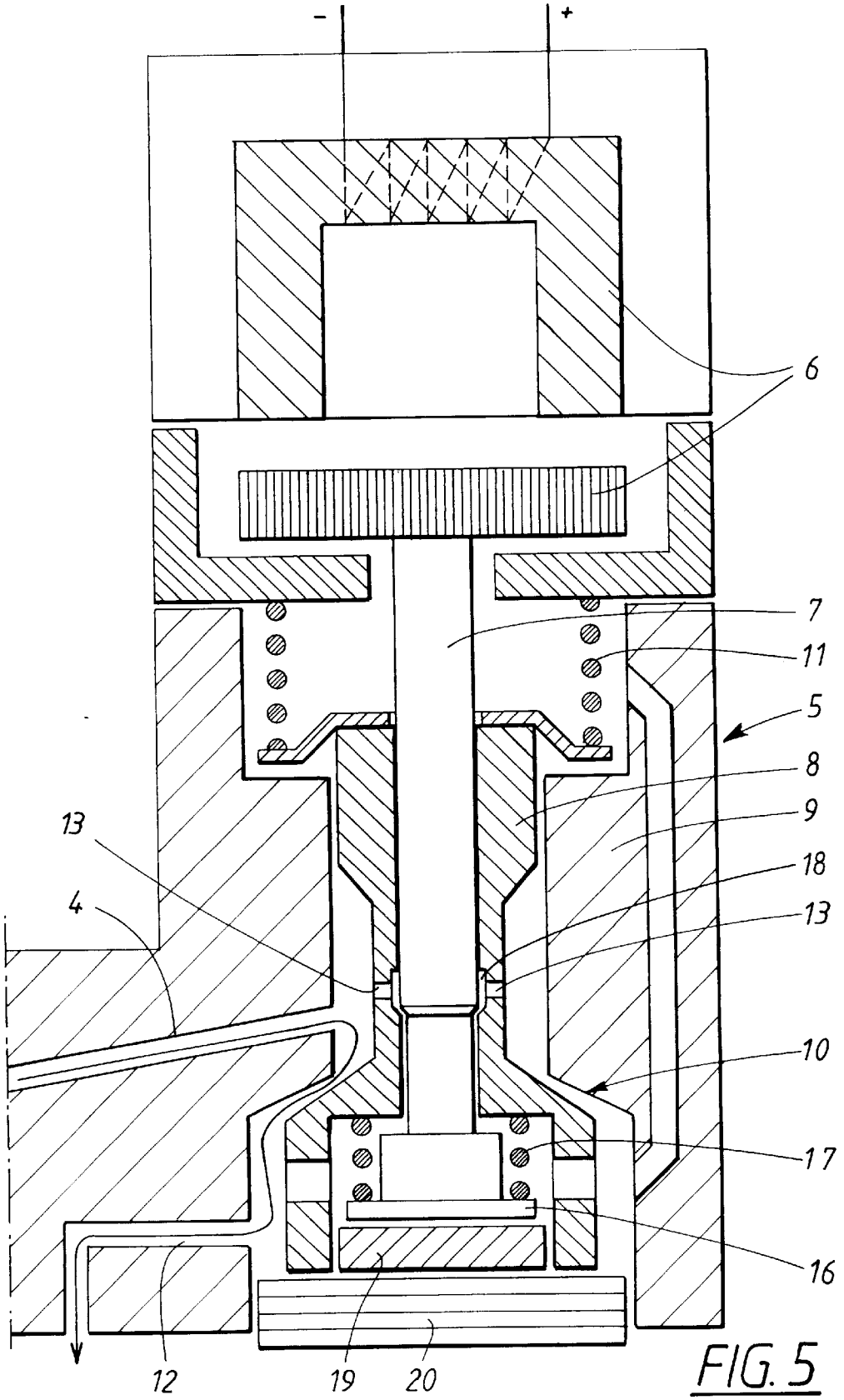
FIG. 5 is a side, elevational, partially sectional view of another embodiment of the control valve according to the present invention having an open main control valve and a closed secondary valve.

FIG. 5 shows another embodiment of the present invention. The reference numerals 4–17 in this figure relate to the same element as in the earlier figures. The difference between this embodiment and that shown in FIGS. 3 and 4 is that the holes 13 face towards a ring-shaped chamber 18 on the inner side of the valve body 8 and around the rod 7. The lower part of the ring-shaped chamber 13 is shaped as a valve seat, and the rod 7 is shaped with an edge against this valve seat so that when the rod 7 is in its lower position the chamber 18 is closed at its bottom. To open the chamber 18 so that liquid may flow out therethrough, the rod 7 must be slightly lifted. In FIG. 5, the secondary valve is shown in its closed position and the main control valve in its open position, i.e. the electromagnet is not activated.

By the method and the apparatus according to the present invention, it has become possible to regulate the pressure of the liquid fuel and the amount of injection thereof in a more accurate manner. The means for bringing about this great advantage is in the provision of the secondary valve, and the concomitant ability to influence both of the valves by two different levels of the electric current to the electromagnet. This switching on of the electric current occurs automatically and it is easy to regulate it by means of the trigger unit of the engine.

No substantial reconstruction of earlier known constructions without secondary valves is necessary with the construction according to the present invention. The valve body in the main control valve is substantially the same as with these earlier constructions, but a central hole must be created to allow the rod to be moved in the cavity. It is very important the rod has a tight sliding fit compared to the valve body so that the secondary valve seals properly in its closed position. It is also important that the two springs are co-axial so that no side forces arise which could lock the secondary valve when the electromagnet is activated in two steps.

The invention is not limited to the embodiment shown but can be varied in different ways within the scope of the claims. Thus, the radial holes 13 may for example consist of elongated slots or non-round holes instead of drilled round holes.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve is in said closed position, and a secondary control valve associated with said primary control valve, said secondary control valve having open and closed positions for relieving at least a portion of said pressure during said predetermined portion of said injecting of said fuel when said secondary control valve is in said open position, wherein said primary control valve comprises a housing, and including a movable valve body movable within said housing between open and closed positions, a first spring member for urging said movable valve body into said closed position, and an electromagnet for urging said movable valve body into said open position upon actuation of said electromagnet, and wherein said movable valve body includes an outer surface and an inner channel, said secondary control valve comprising a movable rod movably disposed within said inner channel of said movable valve body, said movable rod including a first end and a second end, said movable valve body including at least one aperture extending between said outer surface and said inner channel, said movable rod being movable within said inner channel between a first position wherein said movable rod blocks flow through said at least one aperture and a second position wherein said movable rod does not block flow through said at least one aperture, said first end of said movable rod being disposed at a position proximate to said electromagnet, a second spring member disposed between said second end of said movable rod and said movable valve body for urging said movable rod into said first position, said first spring member having a first stiffness and said second spring member having a second stiffness, said second stiffness being greater than said first stiffness whereby actuation of said electromagnet can urge said movable valve body into said closed position and further activation of said electromagnet can urge said movable valve body into said second position.

2. The apparatus of claim 1 wherein said movable rod includes a narrow rod region thereby providing clearance between said narrow rod region and said inner channel whereby said second position of said movable rod comprises said narrow rod region being juxtaposed with said at least one aperture.

3. The apparatus of claim 1 wherein said movable valve body includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

4. The apparatus of claim 1 including a fuel store and an outlet for said control valve thereby permitting the flow of fuel through said control valve when either said primary control valve or said secondary control valve is in said open position, said outlet connected to said fuel store.

5. The apparatus of claim 1 wherein said first spring member is disposed between said movable valve body and said housing.

6. The apparatus of claim 1 wherein said first and second spring members are coaxial.

7. The apparatus of claim 1 wherein said movable valve body includes an expanded region within said inner channel associated with said at least one aperture thereby providing clearance between said movable rod and said expanded region, said movable rod including a narrowed region thereby providing clearance between said narrowed region and said inner channel, whereby said second position of said movable rod comprises said narrowed region of said movable rod juxtaposed with said expanded region of said movable rod body.

8. The apparatus of claim 1 wherein said injector means comprises a piston.

9. The apparatus of claim 1 wherein said fuel comprises a diesel fuel.

10. Apparatus for controlling the injection pressure for fuel through a nozzle for combustion in an engine comprising injecting means for injecting said fuel at a predetermined injection pressure through said nozzle, a primary control valve having open and closed positions for maintaining said pressure during injecting of said fuel when said primary control valve is in said closed position, said primary control valve including a housing and a movable valve body movable within said housing between open and closed positions, a first spring member for urging said movable valve body into said closed position, and a secondary control valve associated with said primary control valve, said secondary control valve having open and closed positions for relieving at least a portion of said pressure during said predetermined portion of said injecting of said fuel when said secondary control valve is in said open position, said movable valve body including an outer surface and an inner channel, said secondary control valve including a movable rod movably disposed within said inner channel of said movable valve body, said movable rod including a first end and a second end, said movable rod being movable within said inner channel between a first position and a second position, and a second spring member disposed between said second end of said movable rod and said movable valve body for urging said movable rod into said first position, said first spring member having a first stiffness and said second spring member having a second stiffness, the second stiffness being greater than the first stiffness.

* * * * *